US006328186B1

(12) United States Patent
Wing

(10) Patent No.: US 6,328,186 B1
(45) Date of Patent: Dec. 11, 2001

(54) FORMABLE GARMENT HANGER

(76) Inventor: Kathleen A Wing, P.O. Box 277, 42 Elm St., Nassau, NY (US) 12123

( * ) Notice: Subject to any disclaimer, the term of this patent is extended or adjusted under 35 U.S.C. 154(b) by 0 days.

(21) Appl. No.: 09/616,324

(22) Filed: Jul. 15, 2000

Related U.S. Application Data

(60) Provisional application No. 60/144,237, filed on Jul. 19, 1999.

(51) Int. Cl.[7] ..... A47G 25/20

(52) U.S. Cl. ..... 223/94; 223/89; 223/98

(58) Field of Search ..... 223/85, 88, 92, 223/98, 94, 89; D6/315

(56) References Cited

U.S. PATENT DOCUMENTS

| | | |
|---|---|---|
| 2,814,426 | 11/1957 | Miller . |
| 3,443,729 | 5/1969 | Hannum . |
| 3,537,625 | 11/1970 | Nuttall . |
| 4,717,053 | 1/1988 | Wang . |
| 4,905,877 | 3/1990 | Gatling . |
| 4,981,242 | 1/1991 | Grahm . |
| 5,046,649 | 9/1991 | Hazenveld . |
| 5,083,152 | 1/1992 | Chen . |
| 5,085,358 | 2/1992 | Larn . |
| 5,145,098 | 9/1992 | Tung . |
| 5,170,916 | 12/1992 | Kokon et al. . |
| 5,277,345 | 1/1994 | Ozaki . |
| 5,344,054 | 9/1994 | Nutter . |
| 5,476,199 | 12/1995 | Halverson et al. . |
| 5,511,701 | 4/1996 | Lam . |
| 5,535,927 | 7/1996 | Garrison . |
| 5,613,627 | 3/1997 | Marks . |
| 5,613,628 | 3/1997 | Burkhalter . |
| 5,664,710 | 9/1997 | Lam . |
| 5,711,464 | 1/1998 | Huang . |
| 5,718,358 | 2/1998 | Long et al. . |
| 5,718,362 | 2/1998 | Silverman . |
| 5,826,759 | 10/1998 | Ohsugi . |
| 6,073,819 | 6/2000 | Wing . |

*Primary Examiner*—Bibhu Mohanty
(74) *Attorney, Agent, or Firm*—Allan Jacobson

(57) ABSTRACT

A formable garment hanger includes a foam tube over a malleable wire. The shape of the hanger is formable by hand manipulation to adapt the hanger to clothing articles of varying size and materials. The flex characteristics of the formable hanger are controlled so that the proximal section of the arms nearest the center is relatively more rigid and the distal section of the arms furthest from the center is relatively less rigid. In one embodiment, an external skeleton adds rigidity. In another embodiment, a variable diameter malleable wire provides the desired rigidity profile. In yet a third embodiment, an internal tube between the malleable wire and the tubular foam housing adds rigidity to the section of the hanger arms nearest the center.

10 Claims, 8 Drawing Sheets

FORMABLE GARMENT HANGER

CROSS REFERENCES TO RELATED APPLICATIONS

Applicant hereby claims the benefit of priority of U.S. provisional patent application Ser. No. 60/144,237 filed Jul. 19, 1999.

FIELD OF THE INVENTION

The present invention relates generally to devices from which clothes are hung. More specifically, the present invention relates to clothes hangers that can adapt to clothing articles of varying size and materials.

BACKGROUND OF INVENTION

Conventional hangers are usually made of wire or rigid plastic or metal rods with a hook and neck centered perpendicularly to a shoulder with left and right opposing arms protruding at a downward angle. Some articles of clothing may be too narrow or too wide across the shoulder lines to properly fit on a fixed shape conventional hanger. In such situations the article of clothing does not hang properly on the hanger and is at risk of becoming permanently distorted by the hanger.

Typically, stretching or over-stressing localized areas of the clothing fabric, specifically in the neck area, which is pulled in either direction from its center position downward, can cause distortion. Also prone to distortion is the shoulder region where bumps may develop as the weight of the clothing article pulls downward under the force of gravity and the tips of the standard garment hanger push out at the shoulder area causing protrusions or bumps in the shoulder region. The distortion problem becomes worse with heavier garments e.g.: overcoats, jackets and sweaters, especially with open weaves. Knit garments are particularly prone to the problem of distortion.

In addition, some articles of clothing require special wash and dry considerations. It is not advisable to dry any sweaters or knit in the clothes dryer due to shrinkage problems. Since hanging wet items produces significant distortions in the neck and shoulder areas of the garment, wet items need to be laid on a flat surface to dry, which is not always convenient.

Adjustable hangers are known. Adjustable hangers provide a changeable shape that can be adjusted to conform to the shape of given garment. A wide variety of mechanical hangers are available which provide mechanisms to adjust the shape of the hanger to match the shape of the garment. One class of adjustable garment hangers includes those constructed of a deformable wire extending through the center of a tubular foam rubber section. U.S. Pat. No. 4,981,242 to Grahm shows an example of a hanger constructed of a flexible wire and tubular foam rubber section that is deformable by hand so as to conform to various garment shapes.

The arms of a deformable tubular foam and wire hanger should be easily adjustable by the user to conform to the shape of the garment. On the other hand, the arms of a deformable tubular foam and wire hanger that are too easily adjustable may not be rigid enough to support the weight of the garment. As a result, the rigidity/flexibility of the arms of a deformable tubular foam and wire hanger is a design compromise between weight bearing capability and ease of adjustment.

SUMMARY OF THE INVENTION

It is desirable that a deformable tubular foam and wire hanger has different deformation characteristics along the length of each of its arms. In particular it is desirable that the hanger arms be relatively more rigid (less flexible) in the region of the hanger arms nearest the center (i.e., the shoulder region), and relatively less rigid (i.e., more flexible) in the region of the hanger arms furthest from the center.

The improved hanger assembly has a relatively more rigid less flexible section for supporting the main weight of the garment near the center, and a relatively more flexible less rigid section that can be deformed by hand more easily to a desired shape, and retain that desired shape without external support.

In accordance with a first embodiment of the present invention, the collar of a deformable garment hanger provides an external skeleton to add rigidity along a first section of each arm of the deformable hanger nearest the center. In one variation of the first embodiment, the hanger collar includes a shoulder support extension beneath each hanger arm. In another variation of the first embodiment, the hanger collar includes a bottom bracket beneath each hanger arm.

In accordance with a second embodiment of the present invention, a variable diameter malleable wire provides different deformation characteristics along the length of each of its arms. The malleability/rigidity characteristics are controlled by tapering the diameter of the malleable wire from a larger value near the center, to a smaller value furthest from the center. A tapered malleable wire can provide precise linear or non-linear control over the deformation characteristics of the deformable garment hanger.

In accordance with one variation of the second embodiment, the malleable wire of the deformable garment hanger includes a first section having a relatively thicker diameter to add rigidity along a first section of each arm of the deformable hanger nearest the center. The malleable wire is then tapered to form a second section having a relatively thinner diameter to reduce rigidity (add flexibility) along a second section of each arm of the deformable hanger furthest from the center.

In accordance with a third embodiment of the present invention, the deformable garment hanger includes an internal tube to add rigidity along a first section of each arm of the deformable hanger nearest the center. In one variation of the third embodiment, the internal rigidity tube extends through the collar to both left and right arms. In another variation of the third embodiment, the internal rigidity tube terminates in an end receptacle in the collar and does not extend through the collar.

A deformable garment hanger in accordance with the present invention uses combinations of one or more elements of the individual embodiments and variations above.

DETAILED DESCRIPTION

Figure 1:
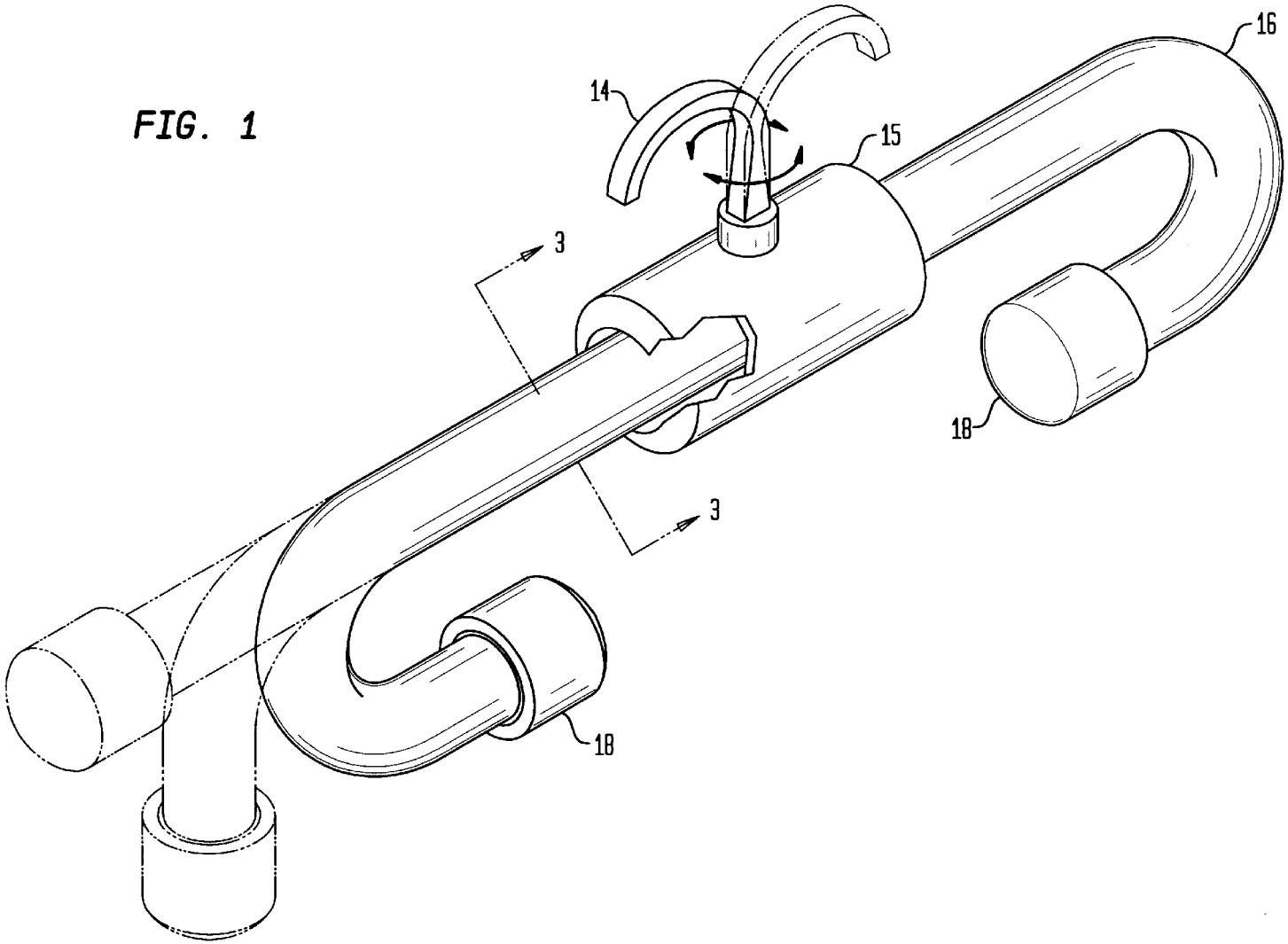
FIG. 1 is a formable garment hanger for use in conjunction with the present invention.
Figure 2:
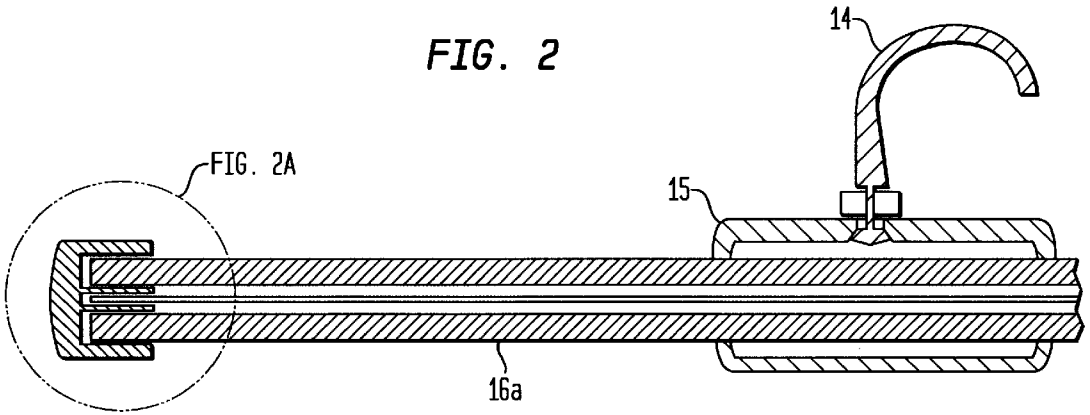
FIG. 2 is a sectional detail of FIG. 1 for use in conjunction with the present invention.
Figure 3:
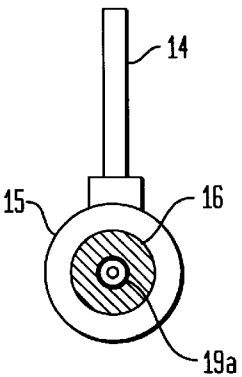
FIG. 3 is a cross sectional side view of FIG. 1 for use in conjunction with the present invention.
Figure 2A:
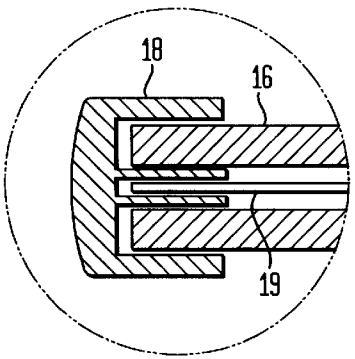

The various embodiments as described below and depicted in the drawings provide a hanger that can be manipulated by hand to a given configuration and retain that given configuration. FIGS. 1, 2 and 3 show the main structure of the formable garment hanger, which can be used in various combinations with all embodiments shown. The embodiments depicted allow for the reconfiguration of the left and right hanger arms while providing a stable center section specifically in the area between the neck and the opposing shoulder or arm sockets. The malleable wire is of a gauge that is both resistant to reconfiguration under the weight of the garment, yet malleable enough to be manipulated by hand and reconfigured by the user.

Reference Numerals in Drawings

Figure 4:
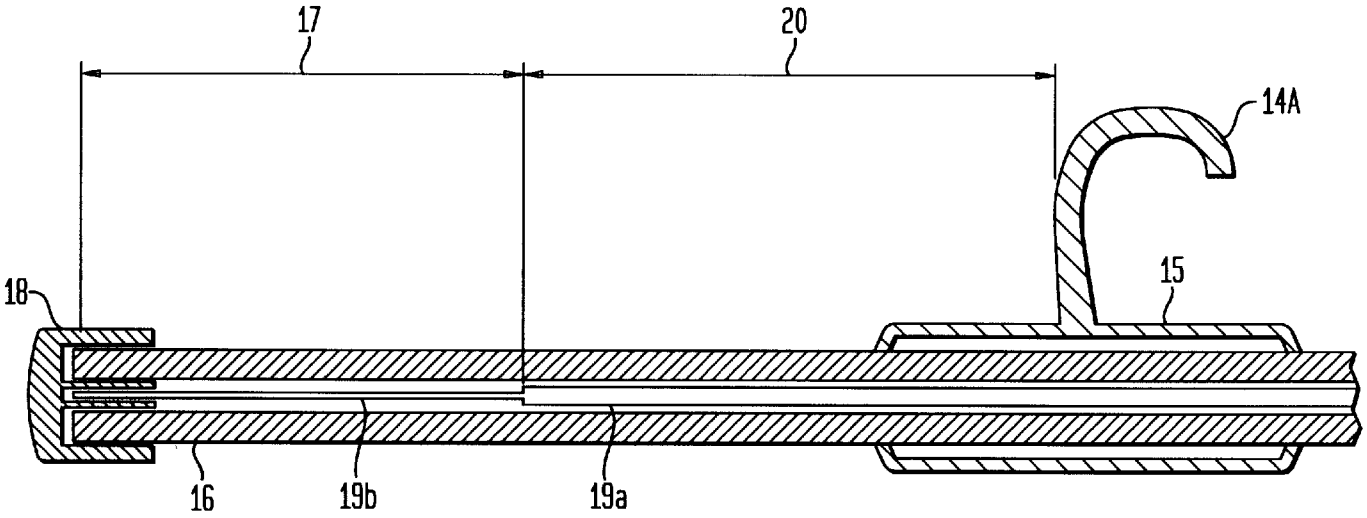
FIG. 4 is a sectional detail of FIG. 1 in accordance with the present invention.
Figure 5:
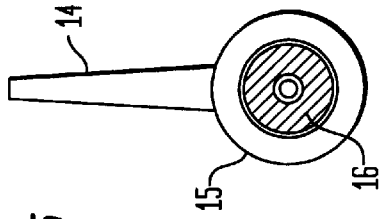
FIG. 5 is a cross sectional side view of FIG. 1 in accordance with an embodiment of the present invention.

14 hook
15 collar
16 foam housing
16*a* one piece foam housing
16*b* two piece foam housing
17 arm extension section
18 end cap
19 malleable wire
19*a* malleable wire center to end
19*b* malleable wire end to center
19*c* tapered region of malleable wire
20 shoulder section
21 end receptacle
22 rigid tube
23 shoulder support
24 tie/belt holder
25 skirt clip
26 pant bar
27 collar bottom bracket
28 tab collar bottom bracket In FIG. 1, a formable garment hanger comprises a hook 14, a collar 15 and respective arms formed by a one piece foam housing 16. End caps 18 are placed at the termination of each hanger arm. The hook 14, which is free to rotate in a circular motion, is also shown in a sectional view in FIG. 2. FIG. 4 shows a stationary version of the hook 14A.

FIG. 2 is a sectional view of FIG. 1 and includes detail A, a sectional view of the end cap 18 holding malleable wire 19 in the center of the tubular foam housing 16. The end cap 18 serves to encapsulate the malleable wire 19 and the foam housing 16. The end cap 18, as shown in FIG. 2, detail A, may be forced fit or glued as a means of attachment.

FIG. 3 is a further sectional side view of FIG. 1 and depicts the malleable wire 19 being of a given diameter 19*a* within the foam housing 16 and griped by the collar 15 and hook 14 combination.

First Embodiment—External Skeleton
FIGS. 1, 2, 3, 10, 11, 12, 13

Figure 10:
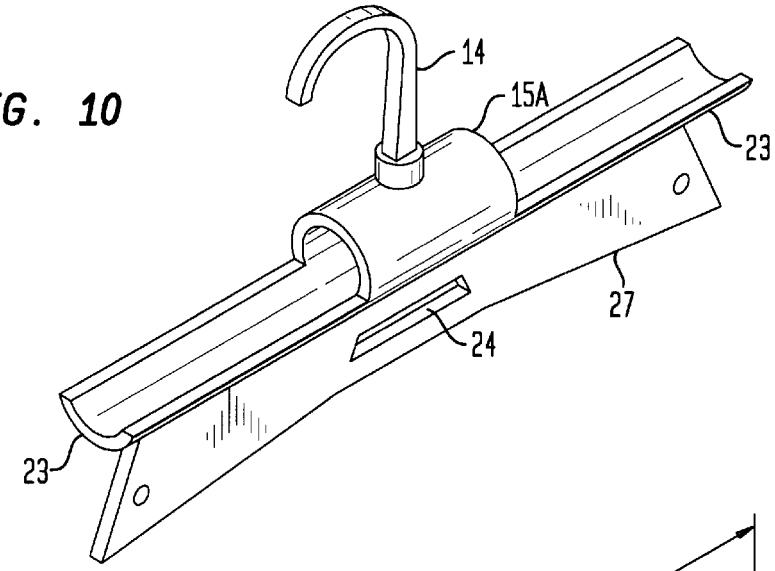
FIG. 10 is a perspective view of a collar for a formable garment hanger in accordance with an embodiment of the present invention.
Figure 11:
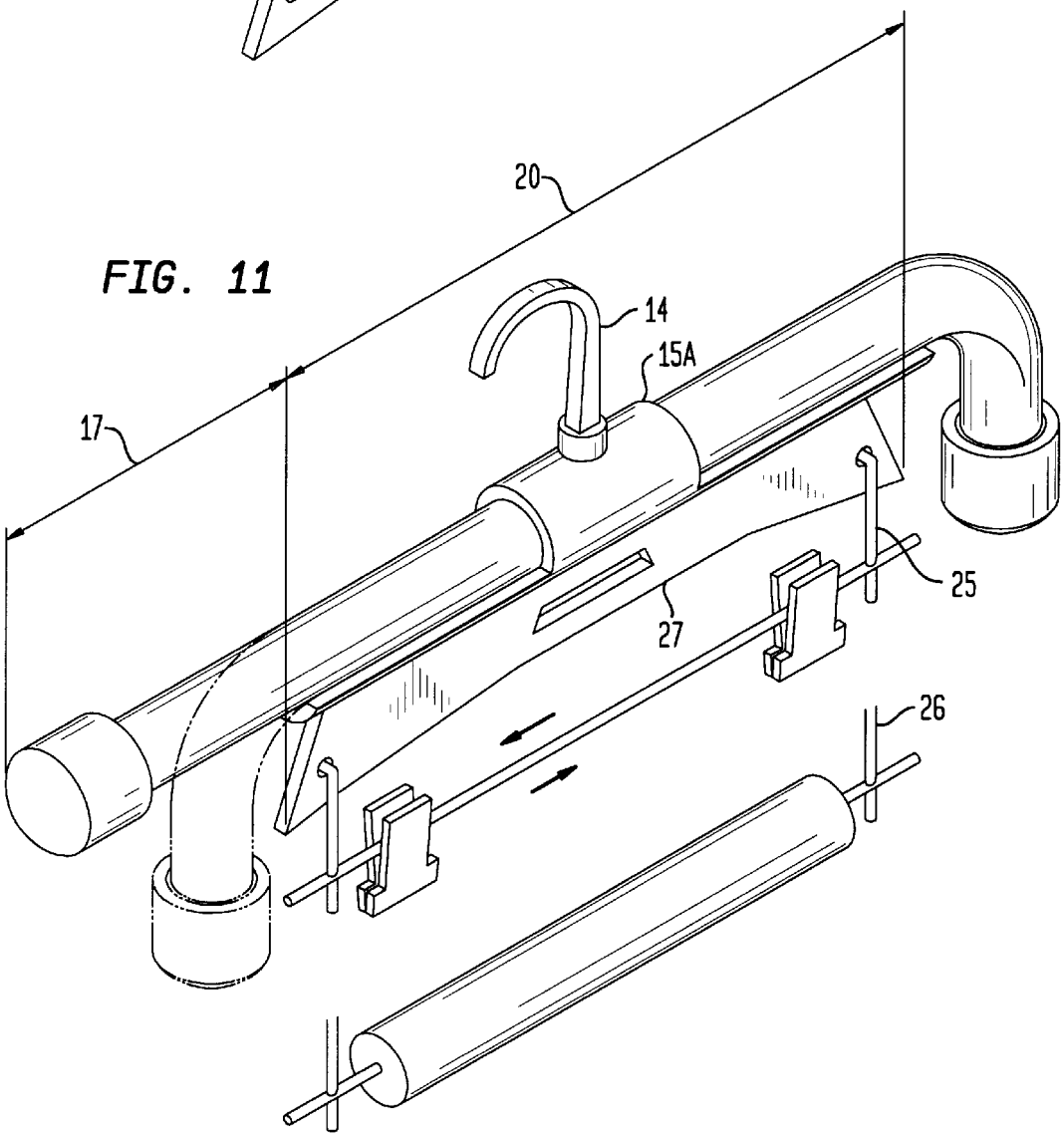
FIG. 11 is an assembled perspective view of an alternate embodiment of a formable hanger in accordance with the present invention.
Figure 12:
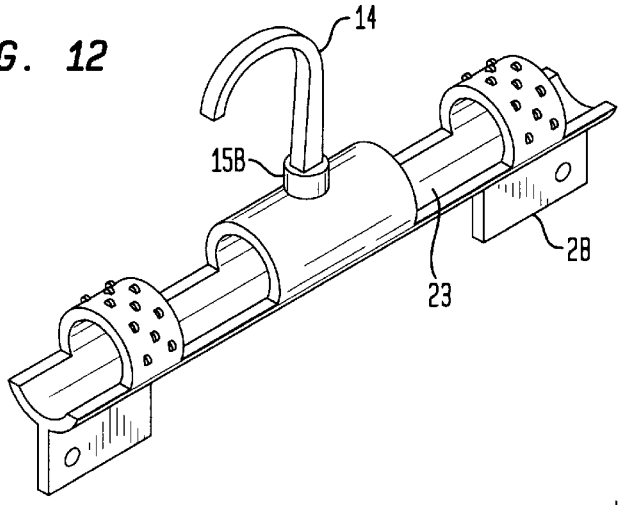
FIG. 12 is a perspective view of a collar for a formable garment hanger in accordance with an embodiment of the present invention.

A variety of external collar supports can be used with the hanger of FIGS. 1–3 as shown in FIGS. 10–13. In FIGS. 10 and 12, the hanger collar itself provides support under or over the shoulder section. The arm extensions are left free standing so they can be manipulated by hand into a desired configuration. An external collar support is considered to be an external skeleton support system and can be designed in a variety of ways.

A supportive collar 15A is shown in FIG. 10. Collar 15A includes a bottom bracket 27, which has a shoulder support surface 23. An opening 24 is provided as a tie or belt holder. FIG. 11 shows the supportive collar 15A of FIG. 10 assembled to the hanger of FIG. 1. The supportive collar 15A increases the rigidity of the hanger arms over a first section 20 where the support surface 23 is close to the center of the hanger. A second section 17 of the arms remains free standing and unencumbered. The bottom bracket 27 of the supportive collar 15A further provides a means for mounting skirt clips 25 or pant bar 26 as shown in FIG. 11.

Figure 13:
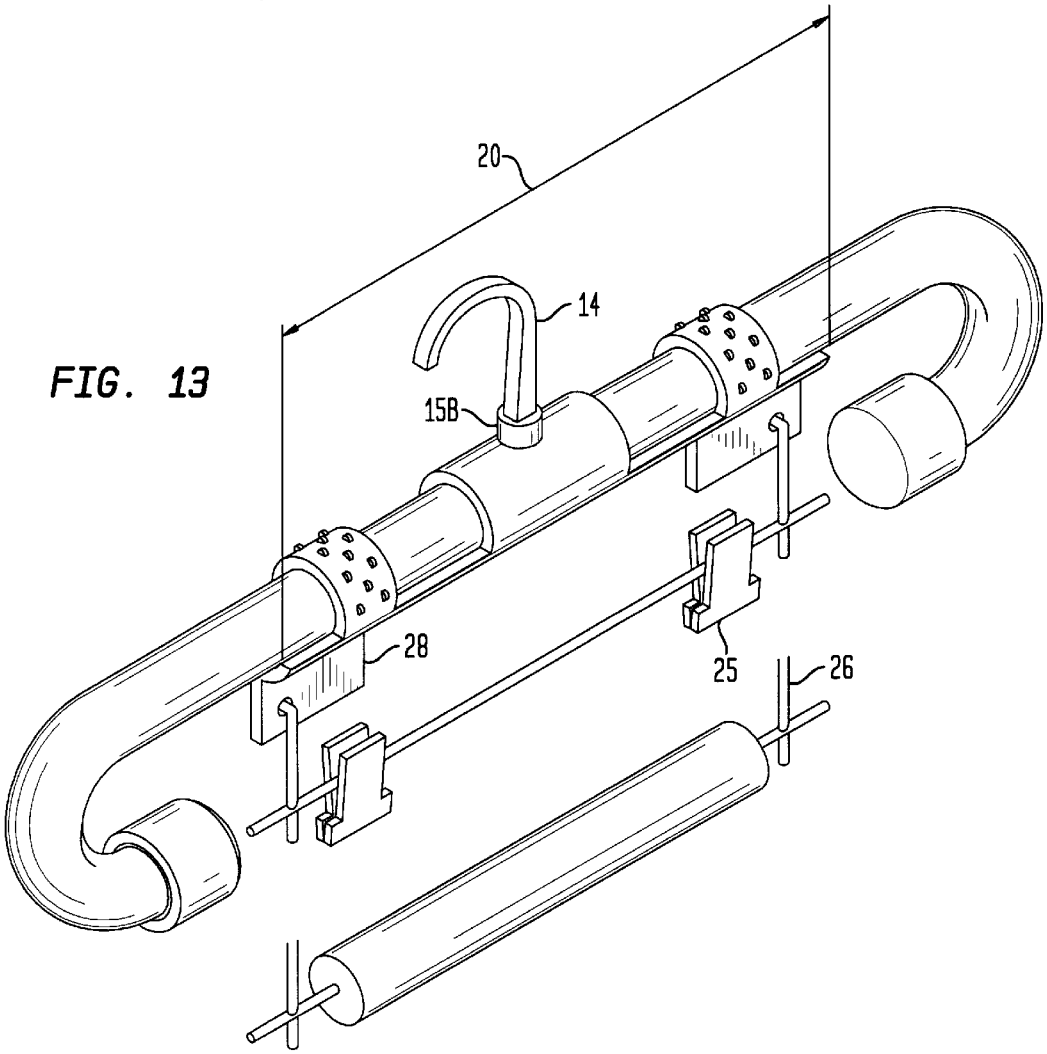
FIG. 13 is an assembled perspective view of an alternate embodiment of a formable hanger in accordance with the present invention.

An alternate embodiment of a supportive collar 15B is shown in FIG. 12. Collar 15B includes a tab collar bottom bracket 28, which has a shoulder support surface 23. FIG. 13 shows the supportive collar 15B of FIG. 12 assembled to the hanger of FIG. 1. The supportive collar 15B increases the rigidity of the hanger arms over a first section 20 where the shoulder support surface 23 is close to the center of the hanger. As before, a second section of the arms remains free standing and unencumbered. The tab collar bottom bracket 28 of the supportive collar 15B further provides a means for mounting skirt clips 25 or pant bar 26 as shown in FIG. 13.

The supportive collars 15A and 15B are flexible elements. As used in the embodiments of FIGS. 11 and 13 each shoulder support surface 23 tends to add rigidity to the respective shoulder sections of each hanger arm.

Second Embodiment—Variable Diameter Malleable Wire
FIGS. 1, 2, 3, 4, 5, 6, The malleable wire 19 in FIG. 1 has a substantially constant diameter over its length. However, in accordance with one embodiment of the present inventions, the diameter of the malleable wire 19 varies over its length in order to control the amount of flexibility or rigidity of the hanger arms.

Figure 6:
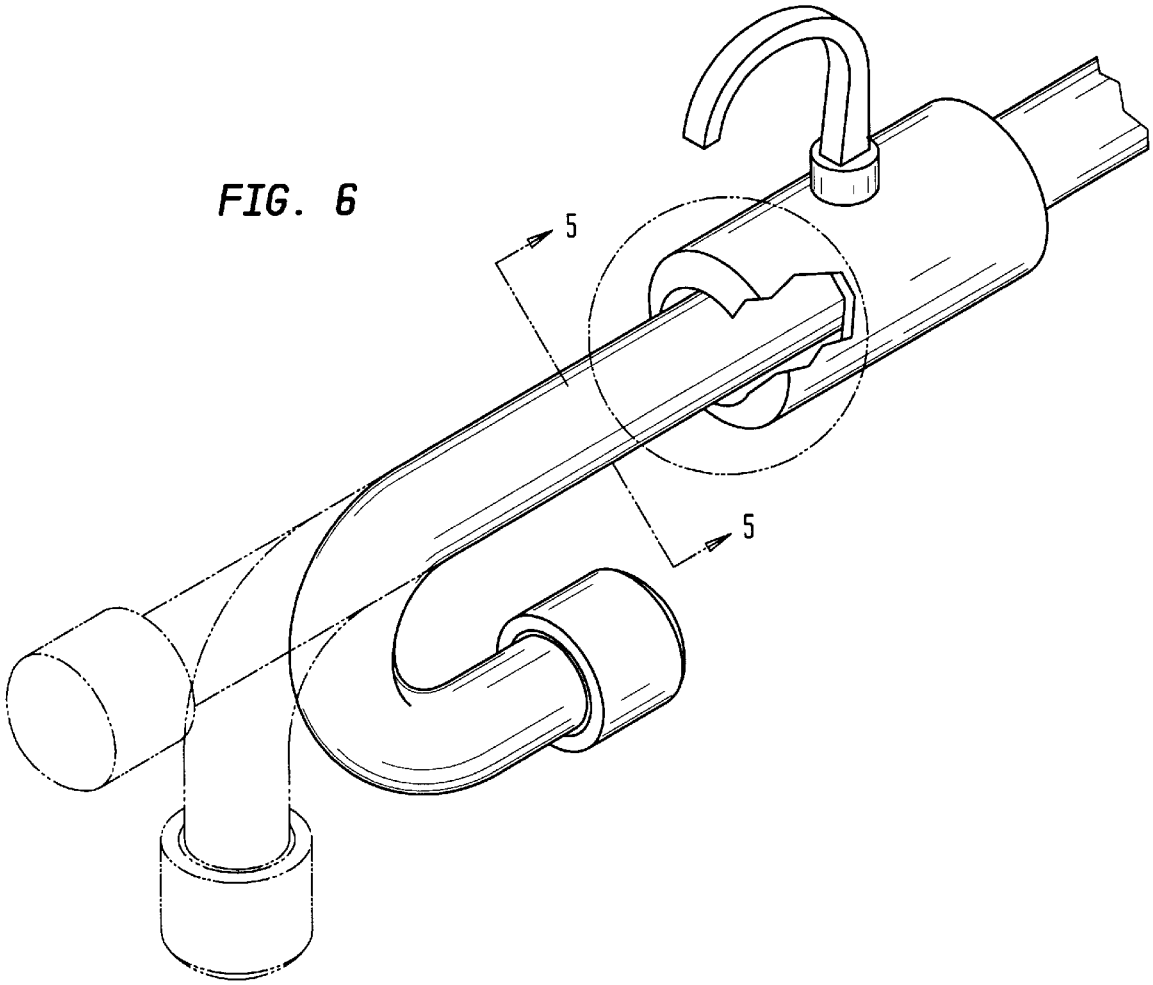
FIG. 6 is a perspective view of a formable hanger in accordance with an embodiment of the present invention.
Figure 6A:
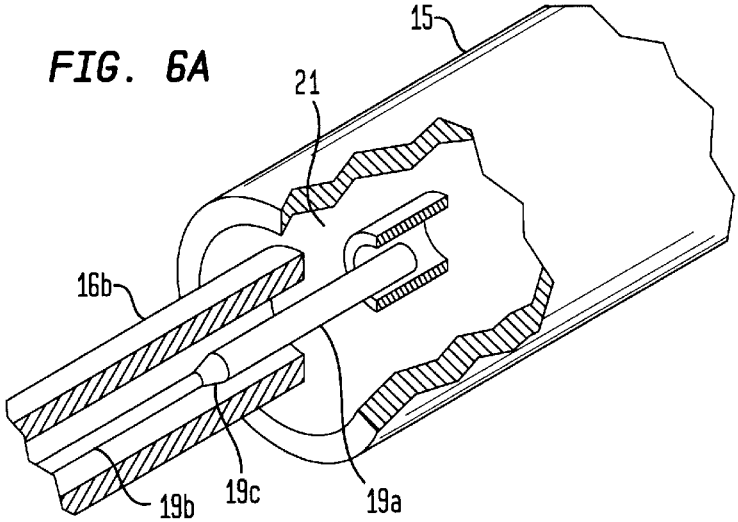

FIG. 4 is a sectional view similar to the hanger of FIG. 1, except that the malleable wire 19 has one diameter 19*a* between its center to one end slightly larger than a second diameter 19*b* between its center to the opposing end. That is, the malleable wire rather than being of one diameter, has a diameter that varies over its length. The larger diameter 19*a* of the wire 19 is close to the center of the hanger providing a slightly firmer (less malleable) shoulder section 20 (in FIG. 4). The smaller diameter 19*b* of the wire 19 is further away from the center of the hanger providing for a slightly more malleable formable arm extension section 17 (in FIG. 4) for the garment hanger. Detail B of FIG. 6 illustrates the varying diameter of malleable wire 19. Between diameters 19*a* and 19*b* there is a transition region 19*c*. In the transition region 19*c*, the diameter tapers off between diameters 19*a* and 19*b*. The diameter of the malleable wire 19 may have different taper profiles between the hanger center and the distal ends of the hanger arms, but it is generally desirable that the hanger be more flexible at the ends and less flexible at the center.

Figure 7:
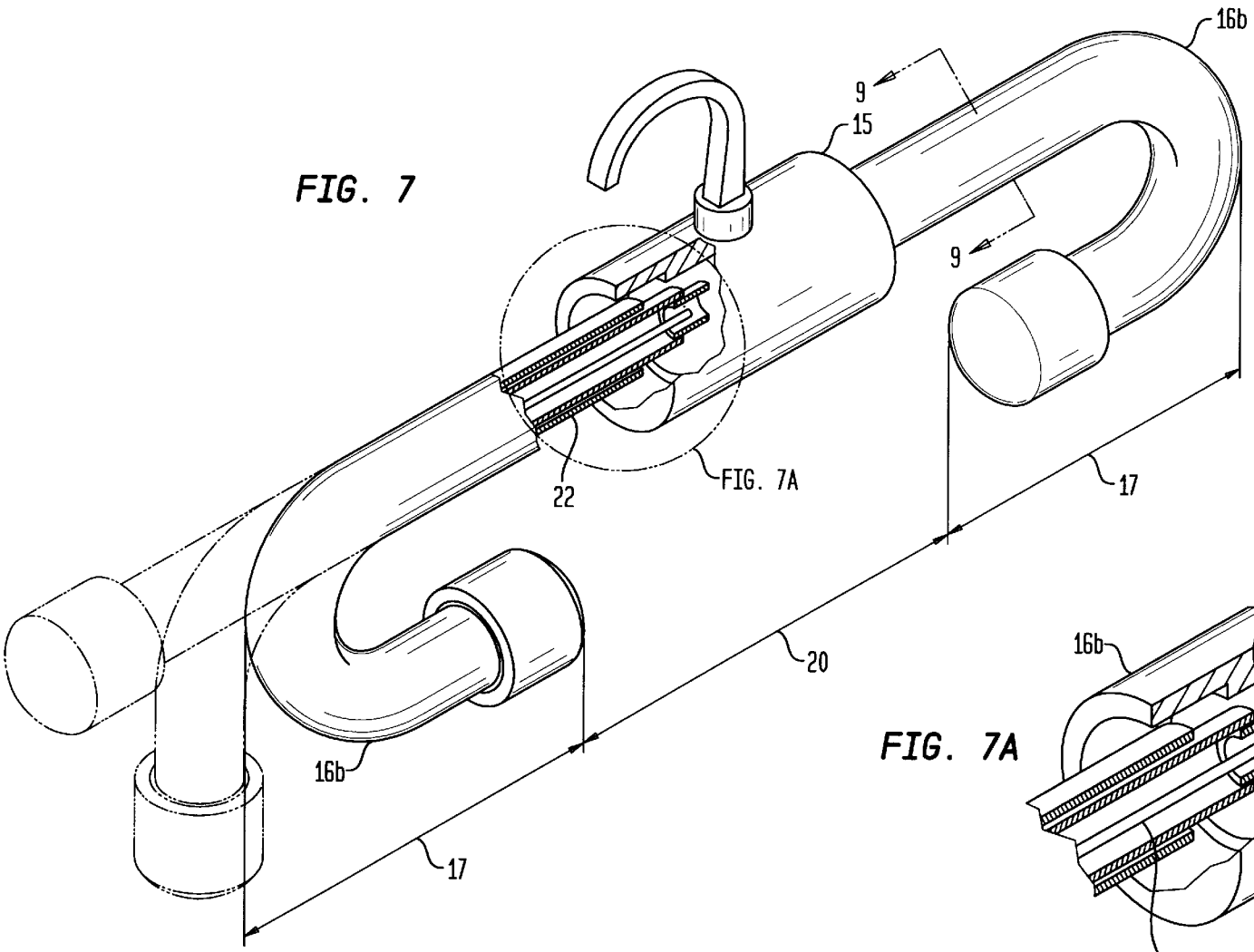
FIG. 7 is a perspective view of an alternate embodiment of a formable hanger in accordance with an embodiment of the present invention.
Figure 7A:
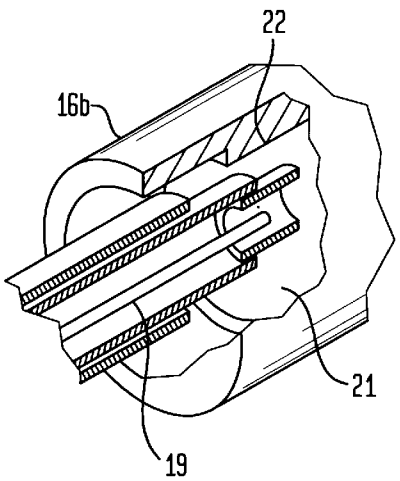

FIGS. 6 and 7 illustrate an alternate embodiment of the present invention. Instead of a single malleable wire and single foam housing extending through the collar (as in FIGS. 2, 4 and 8), both the malleable wire and the foam housing of the embodiment of FIGS. 6 (detail B) and 7 (detail C) terminate in an end receptacle 21 at the collar.

Regardless of whether a single wire is inserted into a single foam housing or two separate wires are inserted into two separate foam housings, the characteristics of the formable hanger are controlled by design of the thickness profile of the malleable wire to create the desired hanger flex. In either case, the larger wire diameter provides a fairly rigid shoulder section that can support relatively heavy clothing articles, and the smaller wire diameter provides more formable arm extensions to provide the means to custom fit the hanger to a specific article of clothing.

Third Embodiment—Internal Rigidity Tube

FIGS. 1, 2, 3, 7, 8, 9

Figure 8:
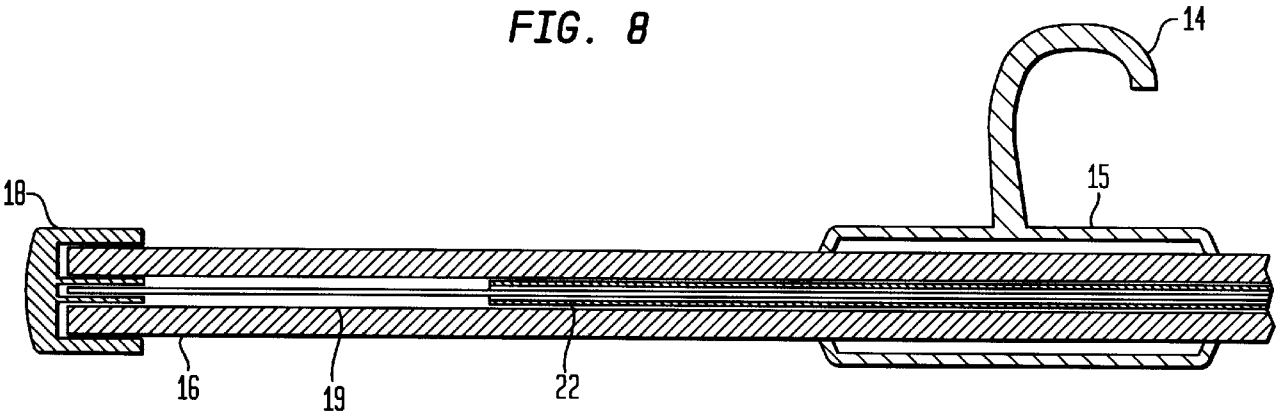
FIG. 8 is a sectional view of FIG. 7.
Figure 9:
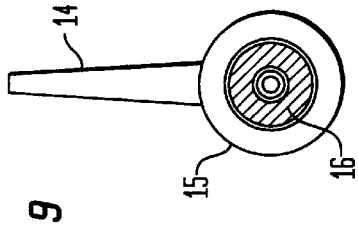
FIG. 9 is a sectional side view of FIG. 7.

In addition, rigidity is added to the shoulder section of each arm of a formable hanger in accordance with the present invention by the use of an internal rigid tube 22 as shown in FIGS. 7, 8 and 9. The tube 22, itself being a flexible element, is not perfectly rigid. As used in the embodiments of FIGS. 7 and 8, the rigidity tube 22 tends to add rigidity to the respective shoulder sections of each hanger arm.

FIG. 7 is a perspective view of formable hanger using a variation of collar 15 which includes end receptacles 21 into which an internal support by way of a rigid tube 22 is used. Inserted into the rigid tube 22 is a malleable wire 19 and over the rigid tube 22 is a foam housing 16, all of which are force fitted or glued to receptacle 21.

The rigid tube 22 houses the malleable wire 19 and is encircled by the foam housing 16. The rigid tube 22 provides a slightly firmer or less malleable shoulder section 20 to the hanger form. In FIG. 7, the rigid tube 22 is forced fit or glued to the collar 15 end receptacle 21. In FIG. 8, the rigid tube 22 passes through the collar 14.

The embodiments shown herein are combined to form a formable hanger with the desired flex characteristics. For example, a tapered malleable wire as shown in FIG. 4, may be used in combination with an external shoulder support as shown in FIG. 12. Other combinations of the disclosed embodiments may be used as well. The structures of the formable hanger of the present invention may also be used to form the arms of a mannequin, which are then deformable to position the arms of the mannequin.

I claim:

1. A garment hangar comprising:

a collar section;

a pair of arms coupled to said collar section, each of said arms comprising a malleable wire;

a foam housing encasing said malleable wire; and an external support member coupled to said collar, said external support member contacting each of said pair of arms along a respective first arm section proximal to said collar, and not contacting each of said pair of arms along a respective second arm section distal from said collar, whereby said external support member causes said first arm section to become a relatively more rigid section for supporting the weight of said garment proximal to said collar, and permits said second arm section to remain a relatively more flexible section for conforming to the shape of said garment distal from said collar.

2. A garment hangar in accordance with claim 1, wherein said external support member comprises a shoulder support attached to said collar section and having a shoulder support surface contacting the underside of said foam housing.

3. A garment hangar in accordance with claim 2, wherein said shoulder support further includes a bottom bracket extending downward from the underside of said shoulder support, said bottom bracket increasing the rigidity of said external support member.

4. A garment hangar comprising:

a collar section;

a pair of arms coupled to said collar section, each of said arms comprising a variable diameter malleable wire, said variable diameter malleable wire including a first section having a relatively thicker diameter along a respective first arm section of said garment hangar proximal to said collar, and a second section having a relatively thinner diameter along a respective second arm section of said garment hangar distal from said collar; and a foam housing encasing said variable diameter malleable wire, whereby said variable diameter malleable wire provides a relatively more rigid first arm section for supporting the weight of said garment proximal to said collar and a relatively more flexible second arm section distal from said collar for conforming to the shape of said garment.

5. A garment hangar in accordance with claim 4, wherein the diameter of said malleable wire is tapered from a relatively larger value proximal to said collar to a relatively smaller value distal from said collar.

6. A garment hangar in accordance with claim 4, wherein said variable diameter malleable wire is a continuous wire including a first section having a substantially constant first diameter and a second section having a substantially constant second diameter, said first diameter being larger than said second diameter.

7. A garment hangar in accordance with claim 6, wherein said continuous wire including said first and second sections further includes a transition region between said first and second sections wherein the diameter of said variable diameter malleable wire tapers off from said first diameter to said second diameter.

8. A garment hangar comprising:

a collar section;

a pair of arms coupled to said collar section, each of said arms comprising a malleable wire;

a hollow tube surrounding a first section of said malleable wire forming a first arm section proximal to said collar and defining a second arm section which is not surrounded by said hollow tube distal from said collar; and a foam housing encasing said hollow tube and said malleable wire;

whereby said hollow tube causes said first arm section to become a relatively more rigid section for supporting the weight of said garment proximal to said collar, and permits said second arm section to remain relatively more flexible for conforming to the shape of said garment distal from said collar.

9. A garment hangar in accordance with claim 8, wherein said pair of arms is formed by a respective pair of first and second malleable wires and a respective pair of first and second hollow tubes attached to said collar section.

10. A garment hangar in accordance with claim 8, wherein said pair of arms is formed by a single continuous malleable wire and a single continuous hollow tube passing through said collar section.

* * * * *